US007165500B1

(12) United States Patent
Yoshino

(10) Patent No.: US 7,165,500 B1
(45) Date of Patent: Jan. 23, 2007

(54) LOOPER FOR TUFTING MACHINE

(75) Inventor: Sota Yoshino, Sakai (JP)

(73) Assignee: Nara Company, Ltd., Osaka (JP)

( * ) Notice: Subject to any disclaimer, the term of this patent is extended or adjusted under 35 U.S.C. 154(b) by 0 days.

(21) Appl. No.: 11/234,316

(22) Filed: Sep. 26, 2005

(51) Int. Cl.
*D05C 15/22* (2006.01)
*D05C 15/24* (2006.01)

(52) U.S. Cl. ..... 112/80.55

(58) Field of Classification Search .... 112/80.5–80.56, 112/80.58–80.6
See application file for complete search history.

(56) References Cited

U.S. PATENT DOCUMENTS 2,090,021 A * 8/1937 Baynton et al. ..... 112/80.59
2,842,080 A * 7/1958 Hoeselbarth ..... 112/80.53
4,353,317 A * 10/1982 Crumbliss ..... 112/80.51
4,419,944 A * 12/1983 Passons et al. ..... 112/80.52
5,509,364 A * 4/1996 Bardsley ..... 112/80.51
5,522,331 A * 6/1996 Stutznacker ..... 112/289

FOREIGN PATENT DOCUMENTS

DE 37 09 977 A1 10/1988

* cited by examiner

*Primary Examiner*—Ismael Izaguirre
(74) *Attorney, Agent, or Firm*—Wenderoth, Lind & Ponack

(57) ABSTRACT

A looper for use in a tufting machine includes a hook throat portion having a bottom edge. Corrugations are formed along the bottom edge. The corrugations provide suitable resistance to loop piles hooked by the hook throat portion, thereby preventing the loop piles from being held in an unexpected position of the hook throat portion. This makes it possible to form loop piles of uniform lengths on carpets. Also, the corrugations will prevent the loop piles from sliding away from a knife so that the loop piles can be reliably, precisely and cleanly cut at constant positions.

20 Claims, 6 Drawing Sheets

LOOPER FOR TUFTING MACHINE

BACKGROUND OF THE INVENTION

The present invention relates to a looper for use in a tufting machine for manufacturing carpets.

FIG. 6 shows a conventional looper 1 which includes a hook throat portion 2 having a bottom edge 3. Loops B are formed on a backing cloth A by moving the looper 1 back and forth as shown by arrows while feeding the backing cloth A in a direction of an arrow. Since the bottom edge 3 is a straight and smooth ground surface, when the backing cloth A and the looper 1 move, tips of the loops B slide along the bottom edge 3 toward an opposite end to a tip of the hook throat portion 2 as shown. When the loops B are cut by knife C, the loops B tend to be pushed by the knife C toward a front corner of the hook throat portion 2 because the knife C has a shear angle D. Some of such loops may not be cut at all or partly cut. Such loops will be either cut again at different positions of a cutting edge or simply torn and will damage the backing cloth and carpet. Accordingly, cut piles thus formed tend to have widely different lengths S relative to each other. Thus, during a later shearing step, a large amount of cut piles have to be removed by shearing so that the cut piles have uniform lengths. A large amount of yarn material is thus wasted. If pile yarns are made of a material having no remaining elongation or a markedly low remaining elongation compared to ordinary tufting yarn, such as yarns for artificial turf, natural fiber yarns, and thick monofilaments, it is especially difficult to cut loops uniformly with conventional loopers having flat edges. Thus, large amounts of defective carpets tend to be produced. In a worst case, tufting is simply impossible.

An object of the present invention is to provide a looper which can form cut piles having uniform lengths, which allows a knife to reliably, precisely and cleanly cut all required loops without the yarn sliding away because of the knife shear angle D, and which has various corrugated shapes and/or a rough surface.

SUMMARY OF THE INVENTION

According to the present invention, there is provided a looper for use in a tufting machine comprising a hook throat portion having a bottom edge formed with corrugations or a rough surface along an entire length thereof or partly along the length thereof. The corrugations may have uniform pitches and heights, or may have uneven pitches and/or uneven heights. Preferably, the corrugations have pitches in the range of about 0.01 to 6 mm and heights in the range of about 0.01 to 2 mm.

With this arrangement, the corrugations formed along the bottom edge of the hook throat portion will provide suitable resistance to loop piles hooked by the hook throat portion, thereby preventing the loop piles from sliding away from the knife and being held in an unexpected position of the hook throat portion. This makes it possible to form loop piles having uniform lengths. The loop piles can be reliably and precisely cut at constant positions. Thus, by using the looper according to the present invention, it is possible to smoothly cut yarns which have been difficult to cut, such as single yarns having a large denier, monofilaments, filaments, tape yarns and natural fibers like cotton.

BRIEF DESCRIPTION OF THE DRAWINGS

Other features and objects of the present invention will become apparent from the following description, made with reference to the attached drawings, in which:

FIGS. 4A' to 4C' are top plan views of FIGS. 4A to 4C, respectively;

DETAILED DESCRIPTION OF THE PREFERRED EMBODIMENTS

Figure 1:
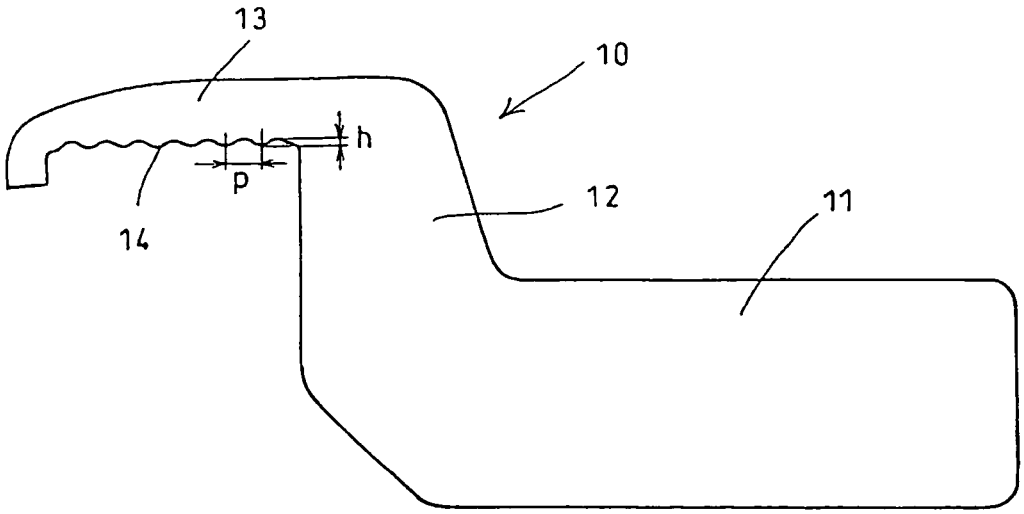
FIG. 1 is a side of a looper embodying the present invention.
Figure 2:
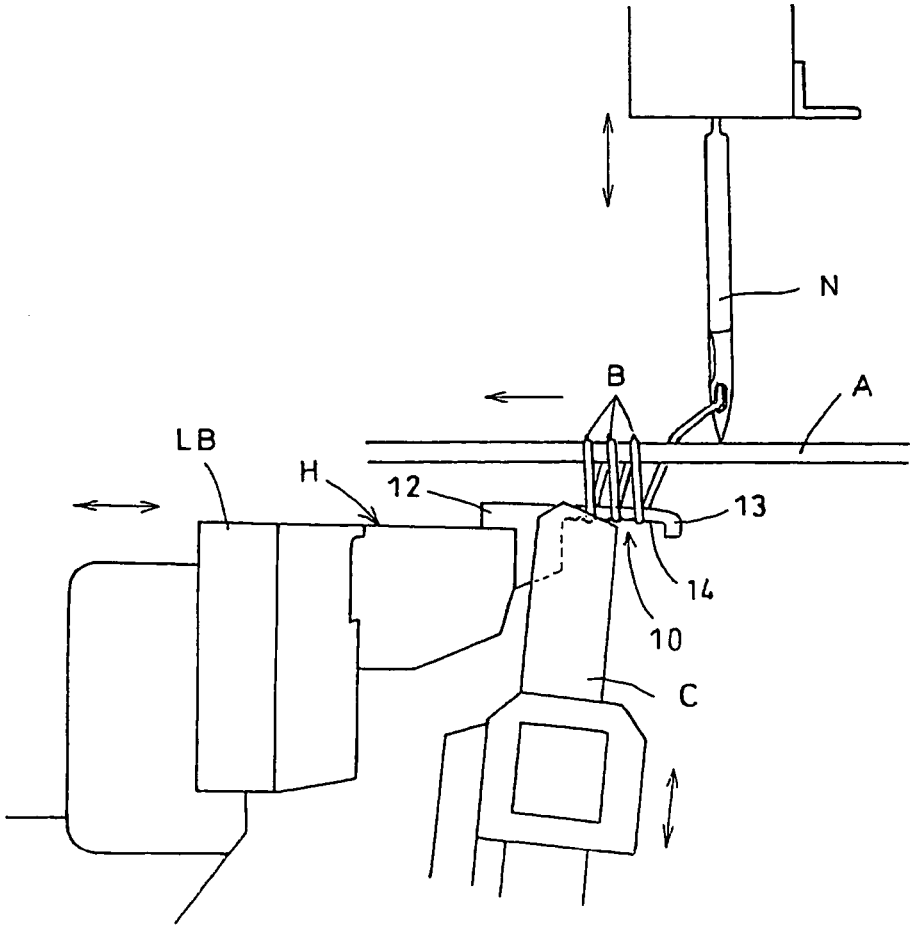
FIG. 2 is a partial enlarged side view of a tufting machine on which the looper of FIG. 1 is mounted.
Figure 3:
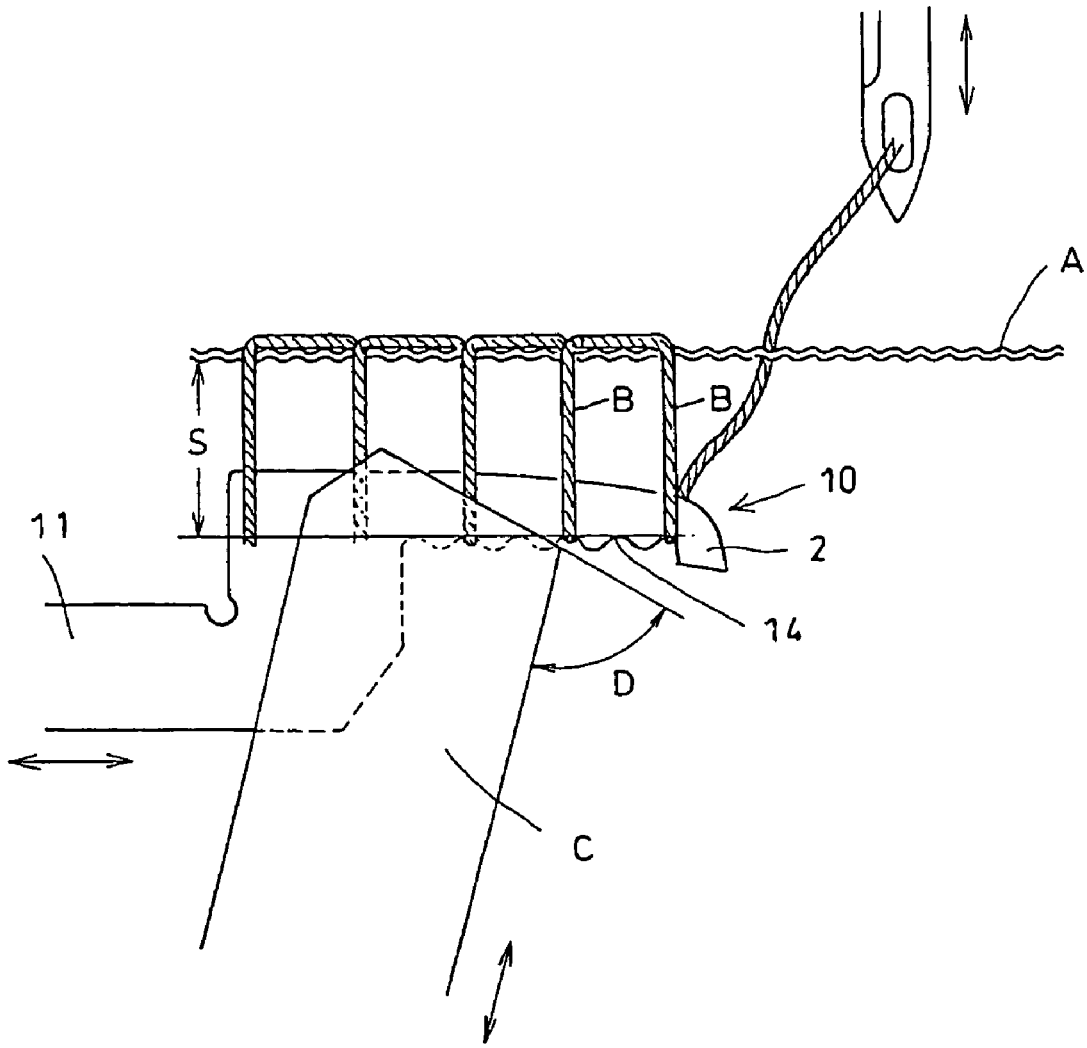
FIG. 3 is a partial enlarged side view of the tufting machine of FIG. 2, showing how the looper of FIG. 1 operates.

Now an embodiment of the present invention is described with reference to FIGS. 1 to 5. As shown in FIG. 1, a looper 10 according to the present invention comprises a base portion 11 supported on a looper block, which is described later, a neck portion 12 extending substantially vertically upwardly from the base portion 11, and a hook throat portion 13 extending substantially horizontally from the neck portion 12 and having a bottom edge 14 which is formed with corrugations along an entire length thereof or partly along the length thereof. The corrugations are typically formed with equal pitches p and heights h. But the corrugations may be formed such that their pitches and/or heights decrease gradually toward a tip of the hook throat portion 13. Preferably, the corrugations have heights h in the range of about 0.01 to 2 mm, more preferably in the range of about 0.1 to 2 mm, and pitches p in the range of about 0.01 to 6 mm, more preferably in the range of about 0.1 to 6 mm.

The looper 10 according to the present invention is mounted on a looper block H of a tufting machine (in a case of a "mold" type, the looper is directly mounted on a looper bar LB). Loop piles B are formed on a backing cloth A which is being fed in a direction of the arrow in FIG. 2 by moving the looper block H back and forth, and vertically moving knife C and needle N, in synchronization with each other. When the looper 10 is in a backward position, shown in FIG. 2, the knife C is raised to cut the piles B to form cut piles. When the piles B are cut by the knife C, the corrugations formed along the edge 14 provide suitable resistance to respective piles B, thus preventing the piles B from sliding along the edge 14 away from the knife C even though the knife C has a shear angle D. Thus, the piles B can be cut reliably, precisely and smoothly at constant positions, so that cut piles of uniform lengths are formed.

Figure 4A:
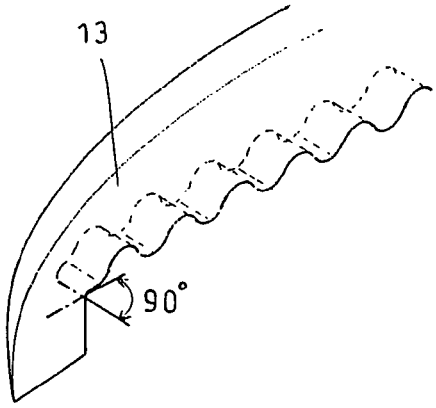
FIGS. 4A to 4F are perspective views of portions of different loopers embodying the present invention, having their respective corrugations arranged so as to extend in different directions relative to each other.
Figure 4A:
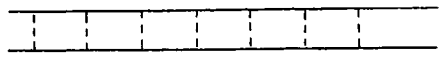
Figure 4B:
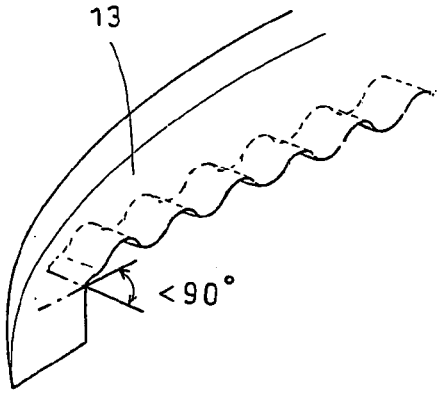
Figure 4B:
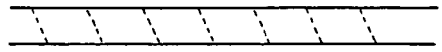
Figure 4C:
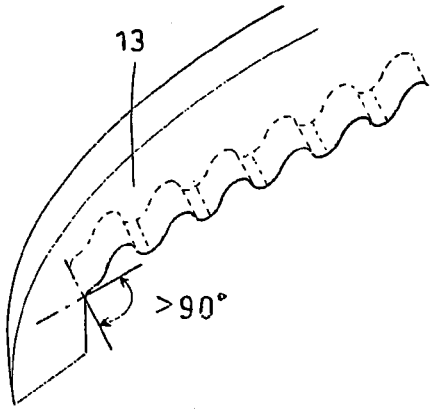
Figure 4C:
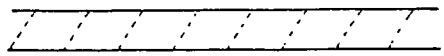

Now referring to FIGS. 4A to 4C and FIGS. 4A' to 4C', crests and troughs forming the corrugations may extend substantially parallel to a width direction of the hook throat portion 13 of the looper (i.e. a direction perpendicular to a side surface of the looper to be brought into sliding contact with the knife C) as shown in FIGS. 4A and 4A', or may extend obliquely toward or away from the tip of the hook throat portion 13 with respect to the width direction of the hook throat portion 13 as shown in FIGS. 4B, 4B' and 4C, 4C'. By adjusting an inclination angle of the crests and troughs forming the corrugations with respect to the width direction of the hook throat portion, it is possible to adjust movement of pile yarns.

Figure 4D:
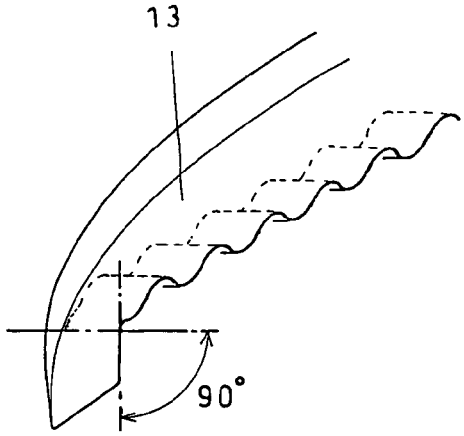
Figure 4E:
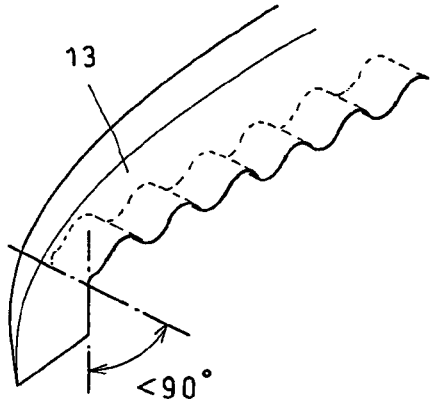
Figure 4F:
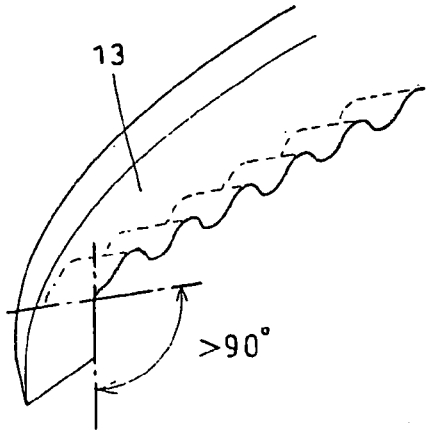

Referring next to FIGS. 4D to 4F, the crests and troughs forming the corrugations may extend substantially horizontally (i.e. perpendicular to a height direction of the hook throat portion 13 of the looper) as shown in FIG. 4D, or may extend obliquely upwardly or downwardly from the side surface of the hook throat portion 13 as shown in FIGS. 4E and 4F. By adjusting the inclination angle of the crests and troughs of the corrugations with respect to the height direction of the hook throat portion 13, it is possible to extend a life of the knife C, adjust movement of the pile yarns and improve cutting energy.

Figure 5A:
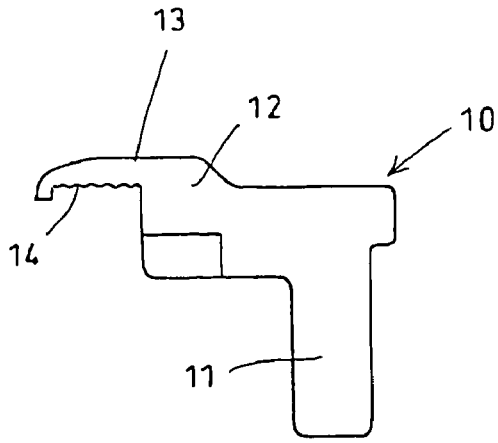
FIGS. 5A to 5C are side views of different loopers embodying the present invention.
Figure 5B:
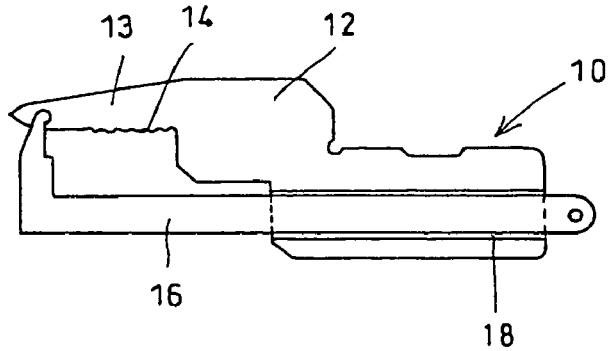
Figure 5C:
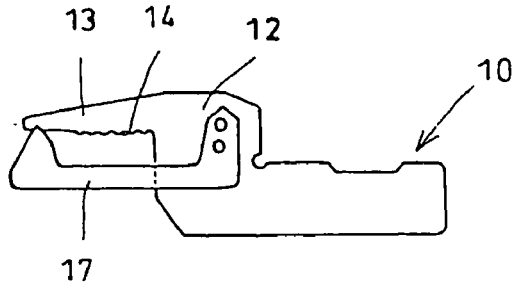
Figure 6:
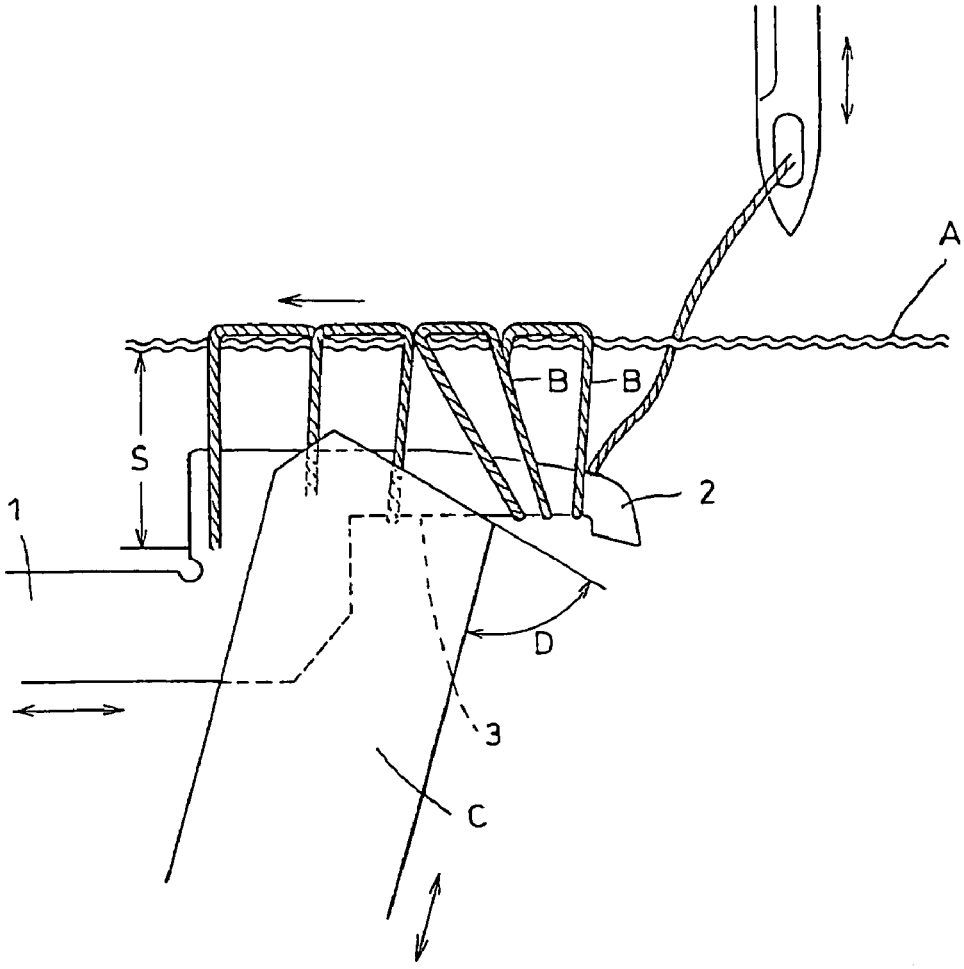
Fig.6 Prior Art
FIG. 6 is a partial enlarged side view of a conventional looper.

The looper 10 according to the present invention is not limited to the looper shown in FIG. 1. For example, the looper 10 according to the present invention may include a vertically downwardly extending base portion 11 as shown in FIG. 5A, may include a spring 16 extending along a groove 18 formed in the base portion 11 as shown in FIG. 5B, or may include a clip 17 connected to the neck portion 12 to sandwich loop piles between the clip 17 and the hook throat portion 13 as shown in FIG. 5C. Further, the looper 10 according to the present invention may be of a molded modular type which comprises 5 to 20 loopers that are formed into a one-piece body by molding.

Instead of the corrugations, the bottom edge may be formed with a rough surface.

What is claimed is:

1. A looper for use in a tufting machine, comprising:

a hook throat portion having a length and a width, said hook throat portion including (i) a side surface extending in a length direction of said hook throat portion, and (ii) a bottom surface extending in the length direction of said hook throat portion, said bottom surface having corrugations over at least a partial length of said bottom surface, said corrugations being defined by ridges and troughs between adjacent ones of said ridges, said ridges extending in a transverse direction relative to the length direction of said hook throat portion, and at least three of said ridges being equally spaced from a line extending in the length direction of said hook throat portion, wherein said looper is constructed and arranged to be used in combination with a knife which is moved up and down along said side surface so as to cut a loop pile caught in one of said troughs.

2. The looper according to claim 1, wherein the pitches of said corrugations are within a range of from about 0.01 mm to about 6.00 mm, and the heights of said corrugations are within a range of from about 0.01 mm to about 2.00 mm.

3. The looper according to claim 1, wherein said corrugations have uniform pitches and uniform heights.

4. The looper according to claim 3, wherein the pitches of said corrugations are within a range of from about 0.01 mm to about 6.00 mm, and the heights of said corrugations are within a range of from about 0.01 mm to about 2.00 mm.

5. The looper according to claim 3, wherein said corrugations extend substantially parallel to a width direction of said hook throat portion.

6. The looper according to claim 3, wherein said corrugations extend obliquely relative to a width direction of said hook throat portion.

7. The looper according to claim 3, wherein each of said ridges, in a width direction of said hook throat portion, extends non-orthogonally relative to the length direction of said hook throat portion.

8. The looper according to claim 3, wherein each of said ridges, in a width direction of said hook throat portion, extends orthogonally relative to the length direction of said hook throat portion.

9. The looper according to claim 1, wherein said corrugations have unequal pitches and/or unequal heights.

10. The looper according to claim 9, wherein the pitches of said corrugations are within a range of from about 0.01 mm to about 6.00 mm, and the heights of said corrugations are within a range of from about 0.01 mm to about 2.00 mm.

11. The looper according to claim 9, wherein said corrugations extend substantially parallel to a width direction of said hook throat portion.

12. The looper according to claim 9, wherein said corrugations extend obliquely relative to a width direction of said hook throat portion.

13. The looper according to claim 9, wherein each of said ridges, in a width direction of said hook throat portion, extends non-orthogonally relative to the length direction of said hook throat portion.

14. The looper according to claim 9, wherein each of said ridges, in a width direction of said hook throat portion, extends orthogonally relative to the length direction of said hook throat portion.

15. The looper according to claim 9, wherein the pitches and/or heights of said corrugations gradually decrease along the length direction of said hook throat portion toward a tip of said hook throat portion.

16. The looper according to claim 15, wherein the pitches of said corrugations are within a range of from about 0.01 mm to about 6.00 mm, and the heights of said corrugations are within a range of from about 0.01 mm to about 2.00 mm.

17. The looper according to claim 15, wherein each of said ridges, in a width direction of said hook throat portion, extends non-orthogonally relative to the length direction of said hook throat portion.

18. The looper according to claim 15, wherein each of said ridges, in a width direction of said hook throat portion, extends orthogonally relative to the length direction of said hook throat portion.

19. The looper according to claim 15, wherein said corrugations extend substantially parallel to a width direction of said hook throat portion.

20. The looper according to claim 15, wherein said corrugations extend obliquely relative to a width direction of said hook throat portion.

* * * * *